US009103287B1

(12) United States Patent
Arbuckle et al.

(10) Patent No.: US 9,103,287 B1
(45) Date of Patent: Aug. 11, 2015

(54) SYSTEMS AND METHODS FOR REDUNDANT DRIVE-BY-WIRE CONTROL OF MARINE ENGINES

(71) Applicant: Brunswick Corporation, Lake Forest, IL (US)

(72) Inventors: Jason S. Arbuckle, Horicon, WI (US); Matthew W. Snyder, Fond du Lac, WI (US); John R. Boatman, Fond du Lac, WI (US); Michael P. Dengel, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 240 days.

(21) Appl. No.: 13/935,044

(22) Filed: Jul. 3, 2013

Related U.S. Application Data

(60) Provisional application No. 61/786,797, filed on Mar. 15, 2013.

(51) Int. Cl.
*F02D 41/26* (2006.01)
*F02D 28/00* (2006.01)

(52) U.S. Cl.
CPC ..... *F02D 28/00* (2013.01)

(58) Field of Classification Search
CPC ..... F02D 28/00; F02D 41/26
USPC ..... 701/21, 22, 93, 102, 103, 110; 440/87
See application file for complete search history.

(56) References Cited

U.S. PATENT DOCUMENTS

| | | | |
|---|---|---|---|
| 6,273,771 | B1 | 8/2001 | Buckley et al. |
| 6,382,122 | B1 | 5/2002 | Gaynor et al. |
| 6,881,106 | B1 | 4/2005 | Gonring |
| 7,399,212 | B2 | 7/2008 | Okuyama |
| 7,941,253 | B1 | 5/2011 | Brant |

*Primary Examiner* — Hai Huynh
(74) *Attorney, Agent, or Firm* — Andrus Intellectual Property Law, LLP

(57) ABSTRACT

Drive-by-wire control systems and methods for a marine engine utilize an input device that is manually positionable to provide operator inputs to an engine control unit (ECU) located with the marine engine. The ECU has a main processor that receives the inputs and controls speed of the marine engine based upon the inputs and a watchdog processor that receives the inputs and monitors operations of the main processor based upon the inputs. The operations of the main processor are communicated to the watchdog processor via a communication link. The main processor causes the watchdog processor to sample the inputs from the input device at the same time as the main processor via a sampling link that is separate and distinct from the communication link. The main processor periodically compares samples of the inputs that are simultaneously taken by the main processor and watchdog processor and limits the speed of the engine when the samples differ from each other by more than a predetermined amount.

20 Claims, 3 Drawing Sheets

SYSTEMS AND METHODS FOR REDUNDANT DRIVE-BY-WIRE CONTROL OF MARINE ENGINES

CROSS-REFERENCE TO RELATED APPLICATION RELATED APPLICATION

The present U.S. utility patent application claims the benefit of and priority to U.S. Provisional Patent Application Ser. No. 61/786,797, filed Mar. 15, 2013, which is incorporated herein by reference in entirety.

FIELD

The present disclosure relates to systems and methods for controlling marine engines.

BACKGROUND

The following U.S. patents are incorporated herein by reference, in entirety.

U.S. Pat. No. 6,273,771 discloses a control system for a marine vessel that incorporates a marine propulsion system that can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

U.S. Pat. No. 6,382,122 discloses an auto detect system for a marine vessel in which the various associations and relationships between marine propulsion devices, gauges, sensors, and other components are quickly and easily determined. The system performs a method which automatically determines the number of marine propulsion devices on the marine vessel and, where needed, prompts the boat builder or marine vessel outfitter to enter various commands to identify particular marine propulsion devices with reference to their location on the marine vessel and to identify certain other components, such as gauges, with reference to both their location at a particular helm station and their association with a particular marine propulsion device.

U.S. Pat. No. 6,881,106 discloses a method for monitoring voltage changes along a cable. First and second controllers monitor voltage potentials at first and second locations along the cable and these voltage potentials are compared to determine whether or not voltage drops exist along the cable. These voltage drops would normally be caused by improperly connected or damaged nodes which increase the resistance to the power provided by a power source.

U.S. Pat. No. 7,399,212 discloses a boat that can include batteries, a generator, a remote control unit provided in a hull, and an outboard motor controlled through the remote control unit so as to generate thrust. The batteries and the generator can be connected to the remote control unit and the outboard motor via power supply cables. The remote control unit and the outboard motor can be connected via drive-by-wire controller area network ("DBW CAN") cables. At least two systems of power supply cables and at least two systems of DBW CAN cables can also be provided.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

In certain examples, a drive-by-wire control system is for a marine engine. The control system can comprise an input device that is manually positionable to provide operator inputs to an engine control unit (ECU) located with the marine engine. The ECU has a main processor that receives the inputs and controls speed of the marine engine based upon the inputs and a watchdog processor that receives the inputs and monitors operations of the main processor based upon the inputs. The operations of the main processor are communicated to the watchdog processor, and vice versa, via a communication link. A sampling link is provided that allows the main processor to command the watchdog processor to sample the inputs from the input device at the same time as the main processor. The sampling link is separate and distinct from the communication link. The main processor periodically compares samples of the inputs that are simultaneously taken by the main processor and watchdog processor and limits the speed of the engine when the samples differ from each other by more than a predetermined amount. The watchdog processor also periodically compares samples of the inputs that are simultaneously taken by the main processor and watchdog processor. The watchdog processor resets the main processor via a reset link when the samples of the inputs differ by a predetermined amount and the main processor does not limit the speed of the engine.

In certain examples, the drive-by-wire control system for the marine engine comprises a throttle lever that is manually positionable to control throttle of the marine engine. A sensor outputs analog voltages based upon positions of the throttle lever. The operations of the main processor are communicated to the watchdog processor via a serial peripheral interface (SPI) bus. The main processor causes the watchdog processor to sample the analog-to-digital counts at the same time as the main processor via the sampling link that is separate and distinct from the SPI bus. The main processor comprises a main analog-to-digital converter and the watchdog microprocessor comprises a watchdog analog-to-digital converter that each convert the voltages output by the sensor to analog-to-digital counts.

In certain examples, methods of operating a drive-by-wire control system for a marine engine can comprise: providing throttle inputs to an engine control unit (ECU) located with the marine engine, wherein the ECU has a main processor that receives the inputs and controls the speed of the marine engine based upon the inputs, a watchdog processor that receives the inputs and monitors operations of the main processor based upon the inputs, and a communication link by which the operations of the main processor are communicated to the watchdog processor; sampling the inputs at the same time with the main processor and watchdog processor, wherein said sampling is facilitated by a sampling link that is separate and distinct from the communication link; controlling, with a main processor located in the ECU, the speed of the engine based upon the inputs; periodically comparing samples of the inputs that are simultaneously taken by the main processor and watchdog processor; and limiting, with the main processor, the speed of the engine when the samples differ from each other by more than a predetermined amount.

BRIEF DESCRIPTION OF THE DRAWINGS

Examples of systems and methods for controlling marine engines are described with reference to the following drawing FIGURES. The same numbers are used throughout the FIGURES to reference like features and components.

DETAILED DESCRIPTION OF THE DRAWINGS

In the present Detailed Description, certain terms have been used for brevity, clearness and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives and modifications are possible within the scope of the appended claims. Each limitation in the appended claims is intended to invoke interpretation under 35 U.S.C. §112, sixth paragraph only if the terms "means for" or "step for" are explicitly recited in the respective limitation.

Figure 1:
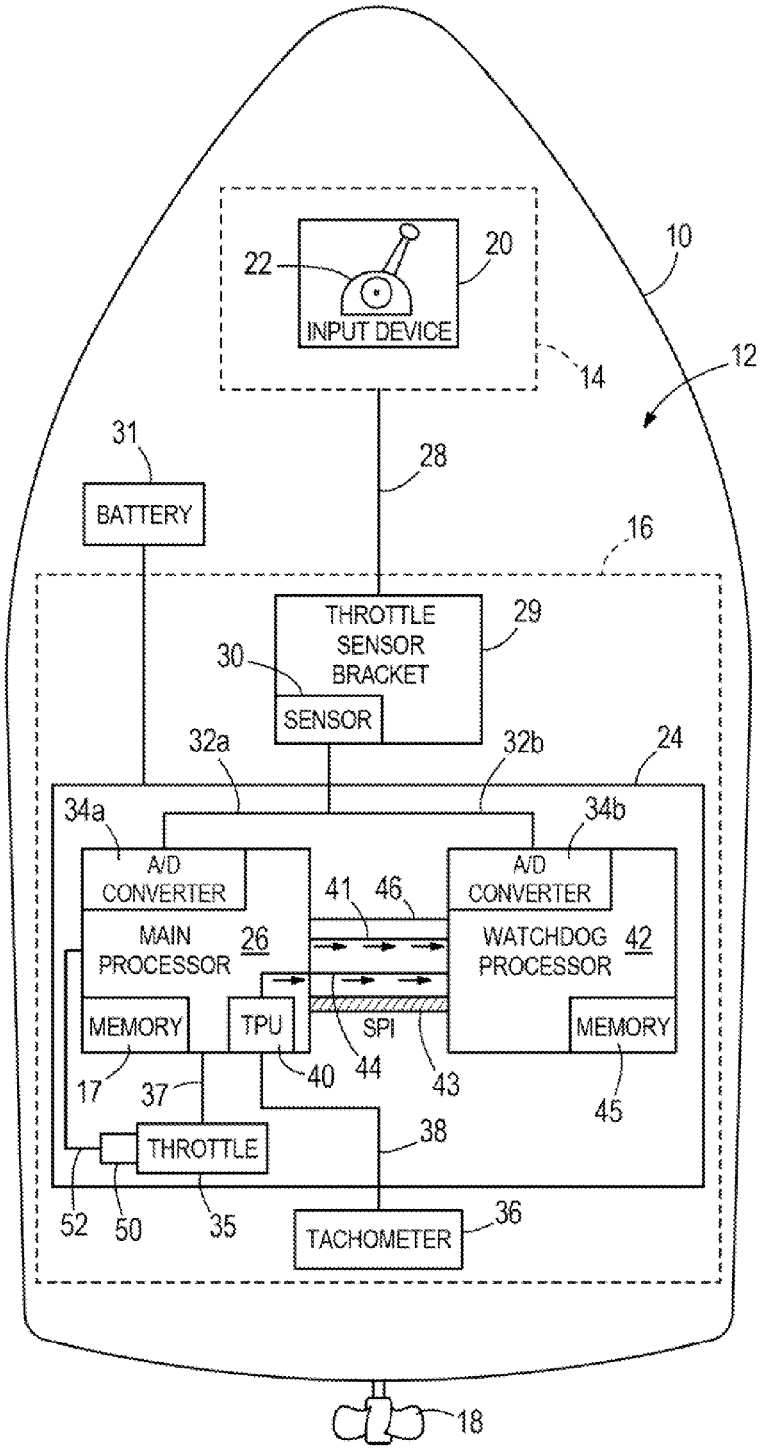
FIG. 1 is a schematic view of a system for controlling a marine engine on a marine vessel.

FIG. 1 schematically depicts a marine vessel 10 having a drive-by-wire system 12. The marine vessel 10 has a helm 14, an internal combustion engine 16 and a propulsor 18. In certain examples, the propulsor 18 can be one or more propellers that are driven into rotation by the engine 16 to propel the marine vessel 10 in a direction of travel. The type and location of propulsor 18 can vary and is not critical. The helm 14 is remotely located from the engine 16. A user input device 20 is located at the helm 14. In certain examples, the user input device 20, among other things, can include a conventional shift and throttle lever 22 for manually controlling shift and throttle of the engine 16. The type of user input device 20 can vary from that which is shown and described.

Manual operation of the user input device 20 provides operator inputs to an engine control unit (ECU) 24, which is located with the engine 16. The ECU 24 is powered by a battery 31 and contains a programmable main processor 26 for receiving the inputs from the user input device 20 and for controlling operations of the engine 16 based on the inputs, including in this example the speed of the engine 16. The main processor 26 is communicatively connected to a computer readable medium 17 that includes volatile or nonvolatile memory upon which a computer readable code is stored. The main processor 26 accesses the computer readable medium 17 and upon executing the computer readable code, carries out functions as described herein. The computer readable medium 17 can be separate from the main processor 26 and/or the computer readable medium 17 can be a part of the main processor 26 or integrally connected to the main processor 26. In still further embodiments, the computer readable medium 17 may be implemented as a plurality of computer readable media for access by the main processor 26.

A mechanical cable 28 connects the input device 20 to a throttle sensor bracket 29 located with the engine 16. A position sensor 30 is located with the throttle sensor bracket 29 and is configured to sense movements of the mechanical cable 28, which reflect movements of (i.e. operator inputs to) the shift and throttle lever 22. The type of position sensor 30 can vary and in certain examples can include one or more conventional potentiometers that output analog voltages based upon the noted movements of the mechanical cable 28 and/or a different one or more conventional linear or rotational position sensors such as non-contacting hall dual output effect sensors that use a magnetic field to measure position and output a voltage. The analog voltages are communicated via a wired or wireless communication link **32*a* to an analog-to-digital converter 34*a* located with the main processor 26. The analog-to-digital converter 34*a* converts the analog voltage to a digital signal for further processing by the main processor 26. Based upon the digital signal, the main processor 26 is programmed to control the speed of the engine 16 via wired or wireless link 37. For example, as the shift and throttle lever 22 is positioned away from a neutral/idle position, the main processor 26 is programmed to open throttle 35 and thus increase speed of the engine 16. Conversely, as the shift and throttle lever 22 is moved towards a neutral/idle position, the main processor 26 is programmed to close throttle 35 and thus increase speed of the engine 16. A throttle sensor 50 is associated with the throttle 35 and senses throttle valve position. Electronic signals representing throttle position are communicated from the throttle sensor 50 to the main processor 26 via a communication link 52**, which can be a wired or wireless link.

For safety reasons and to protect the engine 16 and its related peripheral devices from damage, the main processor 26 is programmed to not allow the speed of the engine 16 to increase above a certain speed threshold. This threshold is saved in the memory 17 of the main processor 26. In addition, the main processor 26 can be programmed to automatically decrease the speed of the engine 16 to idle speed upon detection of a fault in the system 12. A conventional tachometer 36 measures the actual speed of the engine 16 and communicates this information to the main processor 26 via a wired or wireless communication link 38. In this example, the main processor 26 has a Time Processing Unit (TPU) 40 that receives inputs from the tachometer 36 and converts these inputs to a digital engine speed signal for processing by the main processor 26. The TPU 40 is a semi-autonomous co-processor specifically designed to process time critical inputs and outputs. The TPU 40 operates with shared data with the main processor 26 and does not require periodic communications with the main processor 26. This gives the TPU 40 the ability to process time critical inputs and outputs regardless of the operational state of the main processor 26. Therefore, even when the main processor 26 has stopped or is failing to accomplish its desired operation, TPU 40 can continue to operate.

The ECU 24 also contains a watchdog processor 42 that is separate from the main processor 26. Similar to the main processor 26, the watchdog processor 42 is communicatively connected to a computer readable medium 45 that includes volatile or nonvolatile memory upon which the computer readable code is stored. The watchdog processor 42 accesses the computer readable medium 45 and upon executing computer readable code, carries out functions as described herein. The computer readable medium 45 can be separate from the watchdog processor 42 and/or the computer readable medium 45 can be a part of the watchdog processor 42 or integrally connected to the watchdog processor 42. In still further embodiments the computer readable medium 45 may be implemented as a plurality of computer readable media for access by the watchdog processor 42.

Similar to the main processor 26, the watchdog processor 42 also receives the noted inputs from the user input device 20 via the position sensor 30. The watchdog processor 42 has an analog-to-digital converter 34*b* that receives the analog voltages output from the position sensor 30 via a wired or wireless communication link 32*b*. The analog-to-digital converter 34*b* converts the analog voltage to a digital signal for processing in the watchdog processor 42. Based upon the digital signal, the watchdog processor 42 is programmed to monitor the above-noted operations of the main processor 26. For example, as the shift and throttle lever 22 is moved away from a neutral/idle position, the watchdog processor 42 monitors the operations of the main processor 26 to verify that it properly opens throttle 35 of the engine 16 via link 37 and thus increases speed of the engine 16. Conversely, as the shift and throttle lever 22 is moved towards a neutral/idle position, the watchdog processor 42 monitors the operations of the main processor 26 to verify that it properly closes the throttle valve of throttle 35 and thus reduces speed of the engine 16. A communication link 43 is provided between the main processor 26 and the watchdog processor 42 and facilitates the noted monitoring and communication between the watchdog processor 42 during normal operations thereof. In one example, the communication link 43 is a serial peripheral interface bus (SPI) which is a synchronous serial data protocol commonly used by modern microprocessors.

During operations of the system 12, faults can occur that interrupt proper communication between the processors 26, 42 or that cease proper communication between the processors 26, 42 altogether. For example, the main processor 26 can malfunction, thus preventing its ability to properly control the engine 16 and/or preventing its ability to properly communicate with the watchdog processor 42. In other examples, the communication link 43 can itself malfunction, thus preventing communication between the processors 26, 42, even though the processors 26, 42 may be properly operating. In these instances, the watchdog processor 42 typically is not able to determine whether the fault arose because of a malfunctioning of the main processor 26 or a malfunctioning of the communication link 43, or both. Thus, when communication is interrupted or ceases altogether, in order to safely prevent unintended changes in speed of the engine 16 and particularly unintended increases in speed of the engine above the noted speed threshold, the watchdog processor 42 can be programmed to cause the main processor 26 reset (i.e. turn off and then turn back on). A reset link 46 is provided between the main processor 26 and the watchdog processor 42. The reset link 46 is an electrical connection carrying a digital signal which functions regardless of the operational state of communication link 43. The electrical connection is between pins on the main microprocessor 26 and the watchdog processor 42 and can be a direct electrical connection via wire or circuit board trace or could be an indirect electrical connection via wire or circuit board trace through other passive or active electrical components. The watchdog processor 42 can be programmed to output a reset command to the main processor 26 via the reset link 46 when the engine speed signal from the TPU 40 indicates that the engine 16 is operating at a speed that is above the noted threshold. Alternately, the watchdog processor 42 can be programmed to output a reset command to the main processor 26 when the watchdog processor 42 determines that the speed at which the engine 16 is operating is not reduced to idle speed. The reset link 46 allows the watchdog processor 42 to command the main processor 26 to reset and thereby hopefully resolve the problem.

However, the present inventors have determined that resetting the main processor 26 can be highly undesirable because it can cause the engine 16 to stall and thus potentially can leave the operator of the marine vessel 10 stranded. For example, in instances where the communication link 43 is malfunctioning, but the main processor 26 is properly functioning, it is not desirable for the watchdog processor 42 to unnecessarily reset the main processor 26. To overcome this problem, the present inventors have designed the present system 12 in a manner that allows the watchdog processor 42 to better manage communication faults/errors (e.g. faults in the operational conditions of the main processor 26 and/or the communication link 43) without necessarily resetting the main processor 26, and therefore without potentially causing the engine 16 to stall. The system 12 thus can increase safety and also protect the engine 16 and its peripheral components by preventing unintended acceleration of the vessel 10 during fault situations.

As shown in FIG. 1, an engine speed link 44 is provided between the main processor 26 to the watchdog processor 42. In this example, the engine speed link 44 is an electrical connection carrying a digital signal that has a frequency proportional to the engine speed. The electrical connection is between pins on the main microprocessor 26 and the watchdog processor 42 and can be a direct electrical connection via wire or circuit board trace or could be an indirect electrical connection via wire or circuit board trace through other passive or active electrical components. The TPU 40, which as explained above operates regardless of the operational state of the main processor 26, communicates engine speed signals to the watchdog processor 42, thus informing the watchdog processor 42 of the speed at which the engine 16 is operating.

When communication fails between the main processor 26 and the watchdog processor 42, the watchdog processor 42 is programmed to determine (e.g. infer) whether the main processor 26 is properly functioning based upon the speed of the engine 16, as communicated to the watchdog processor 42 via the engine speed link 44. More specifically, regardless of the operating condition of the main processor 26 and communication link 43, the tachometer 36 continues to measure present speed of the engine 16 and communicate this information to the TPU 40. In turn, the TPU 40 continues to output engine speed signals representative of the current speed of the engine 16 to the watchdog processor 42 via the engine speed link 44.

As explained above, the main processor 26 is programmed to limit the speed at which the engine 16 is operating to below a threshold. When communication fails between the main processor 26 and the watchdog processor 42, the watchdog processor 42 is programmed to monitor the speed of the engine 16 and to reset the main processor 26 when the speed of the engine 16 is above the noted threshold. If the speed of the engine 16 is below the threshold, the watchdog processor 42 will assume or infer that the main processor 26 is properly functioning and assume or infer that the reason for non-communication between the main processor 26 and watchdog processor 42 is due to a peripheral error not related to the main processor 26, such as a malfunctioning of communication link 43.

If the engine speed signal indicates that the engine 16 has reduced to idle speed, then the watchdog processor 42 can be programmed to assume that the main processor 26 is still functioning, has also recognized the loss of communication, and has reverted to a forced idle mode under its fault management programming. In this case, there is no need to reset the main processor 26. Conversely, if the watchdog processor 42 monitors the engine speed signal and finds that the engine 16 is not reducing to idle speed, then the watchdog processor 42 can be programmed to reset the main processor 26. This reserves the reset option for situations where the main processor 26 is not in control, but also when the speed at which the engine is operating is high. Elevated engine speed creates more rotating inertia of the engine 16 and can be used to keep the engine 16 spinning while the main processor 26 is being reset, thereby preventing stalling of the engine 16.

There are several other advantages to resetting the engine 16 based upon the engine speed signal, as opposed to providing another type of communication link to the watchdog processor 42. First, whatever problem caused the lack of communication between the respective processors 26, 42 has a high likelihood of affecting other similar communications, but likely will not affect the signal path from the tachometer 36. Second, there are cost advantages to using the signal from the tachometer 36. Watchdog processors 42 are typically very small and inexpensive because they do not perform heavy processing. A larger, more expensive microprocessor may have to be selected to add hardware functionality and a second communication bus, which could otherwise be avoided by simply monitoring the noted engine speed signals. Third, adding another communication bus and keeping it synchronized with the communication link 43 adds complexity to the software. Further, the output from the tachometer 36 is processed by the TPU 40 of the main processor 26. Despite not being on its own silicon chip, the TPU 40 serves as another processor that reads hardware pins for the crank position sensor and generates the engine speed signals and other signals. This separation from the processing functions of the main processor 26 makes the engine speed signal ideal for communicating engine speed to the watchdog processor 42.

During operation of the system 12, faults can also occur in the analog-to-digital convener 34*a* of the main processor and/or the analog-to-digital converter 34*b* of the watchdog processor 42. For example, either one or both of the analog-to-digital converters 34*a*, 34*b* can malfunction, thus preventing the ability to properly receive and/or output engine speed signals to the respective processors 26, 42. According to the present disclosure, the main processor 26 is advantageously configured to monitor the operations of its analog-to-digital converter 34*a* by periodically comparing samples of the inputs taken by the analog-to-digital converter 34*a* and the analog-to-digital converter 34*b*. The respective samples are stored in at least one of the memories 17, 45, in this example the memory 17 associated with the main processor 26. The main processor 26 is programmed to compare the respective samples and determine whether the samples are different by a predetermined threshold amount. If the samples vary by more than the predetermined threshold amount, the main processor 26 is programmed to assume that there is a malfunction and therefore limit the speed of the engine 16 by controlling the position of the throttle 35, as discussed above. In certain examples, the main processor 26 is further programmed to decrease the speed of the engine 16 to idle speed. Additionally, the watchdog processor 42 is advantageously configured to monitor the operations of its analog-to-digital converter 34*b* by periodically comparing samples of the inputs taken by the analog-to-digital converter 34*b* and the analog-to-digital converter 34*a*. The respective samples are stored in at least one of the memories 17, 45, in this example the memory 45 associated with the watchdog processor 42. The watchdog processor 42 is programmed to compare the respective samples and determine whether the samples are different by a predetermined threshold amount. If the samples vary by more than the predetermined threshold amount, the watchdog processor 42 is programmed to assume that there is a malfunction and therefore verify that the main processor 26 is limiting the speed of the engine 16 by controlling the position of the throttle 35. In addition, the watchdog processor 42 can be programmed to monitor the speed of the engine 16 by monitoring the position of throttle valve in the throttle 35, and then reset the main processor 26 via the reset link 46 when the samples vary by more than the predetermined threshold amount and the speed of the engine 16 is above the noted speed threshold. In other words, the watchdog processor 42 is advantageously programmed to assume that the main processor 26 is malfunctioning when the samples vary by more than the predetermined threshold amount and the main processor 26 is not properly limiting the speed of the engine 16.

Figure 2:
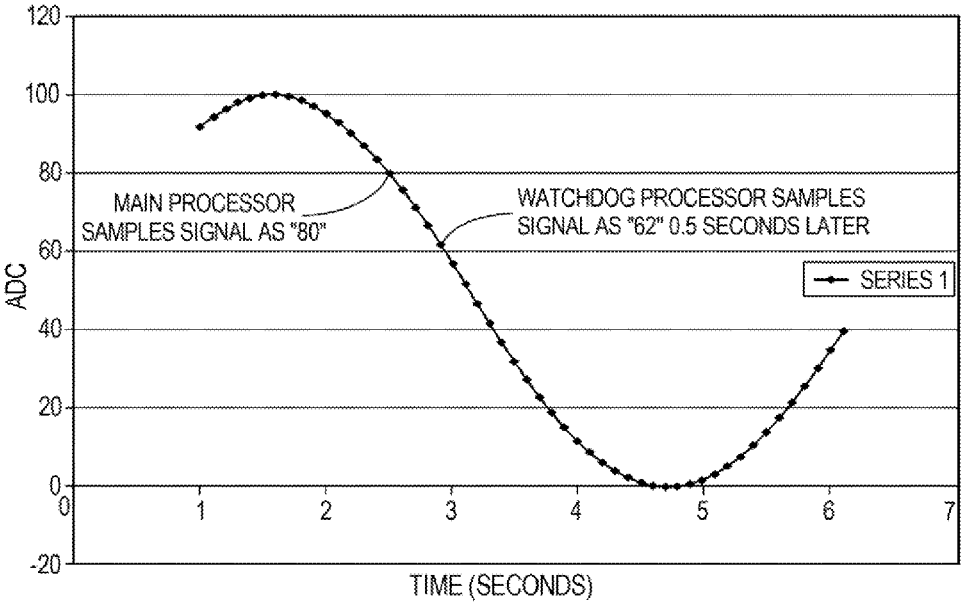
FIG. 2 is a graph depicting samples of analog-to-digital counts that are based upon movement of a throttle lever.

The present inventors have also determined that while both the main processor 26 and watchdog processor 22 are sampling the same electrical connections, in practice one of the processors 26, 42 may sample the connection at a slightly different time than the other. Depending upon the rate of change of the signals, this can cause significant differences in the respective sampled values. For example, the analog-to-digital values can be significantly different because of an inherent time delay that occurs between the respective sampling activities of the processors 26, 42. FIG. 2 shows a graph of one example, wherein analog-to-digital counts are displayed on the Y-axis and time (seconds) is shown on the X-axis. Samples taken by the main microprocessor 26 and watchdog processor 42 are 0.5 seconds apart and therefore differ by 18. This requires a relatively high diagnostic threshold. Each processor has its own clock source. Both the watchdog processor 42 and the main processor 26 are real-time processors and contain an operating system that is running at a clock rate unique to each processor. This clock rate is unique to each processor and is not synchronized between the main and watchdog processors 26, 42. For example, the main processor 26 and watchdog processor 42 could sample the signals at half a second intervals. Because the clock rates are not synchronized between the processors 26, 42, the samples taken by the main processor 26 and the samples taken by the watchdog processor 42 occur up to half a second apart.

According to the present disclosure, the system 12 advantageously includes a sampling link 41 that is separate and distinct from the communication link 43. The sampling link 41 is an electrical connection that carries a digital signal which functions regardless of the operational state of the communication link 43. The electrical connection is between pins on the main microprocessor 26 and the watchdog processor 42 and can be a direct electrical connection via wire or circuit board trace or could be an indirect electrical connection via wire or circuit board trace through other passive or active electrical components. In this example, the main processor 26 is programmed to periodically (e.g. at periodic times) instruct or otherwise cause the watchdog processor 42 to sample the inputs to the analog-to-digital converter 34*b* and the analog-to-digital converter 34*a*. The samples are then stored in one of the memories 17, 45, such as the memory 17. Thereafter, the main processor 26 and the watchdog processor 42 are configured to periodically compare the respective sample sets to determine whether the sample sets are within a predetermined threshold amount of each other. If yes, then the main processor 26 continues normal operation. If no, then the main processor 26 is programmed to limit speed of the engine 26 by controlling the throttle 35, as described herein above. The sampling link 41 causes both the watchdog processor 42 and the main processor 26 to sample the inputs of the analog-to-digital converters 34*a* and 34*b* respectively at the same instant in time. The sampling link 41 can take advantage of hardware interrupts to remove the delays inherent with communication link based sampling requests. Additionally, the sampling link 41 synchronizes the sampling between the main processor 26 and watchdog processor 42 and makes the sampling rate independent of the individual clock rates of the processors. The watchdog processor 42 monitors operations of the analog-to-digital converter 34*a* by determining whether the main processor 26 decreases speed of the engine 16 when the samples differ from each other by more than the predetermined threshold amount. The watchdog processor 24 resets the main processor 26 via the reset link 46 when the samples differ from each other by more than the predetermined threshold amount and the main processor 26 does not limit the speed of the engine 16.

Figure 3:
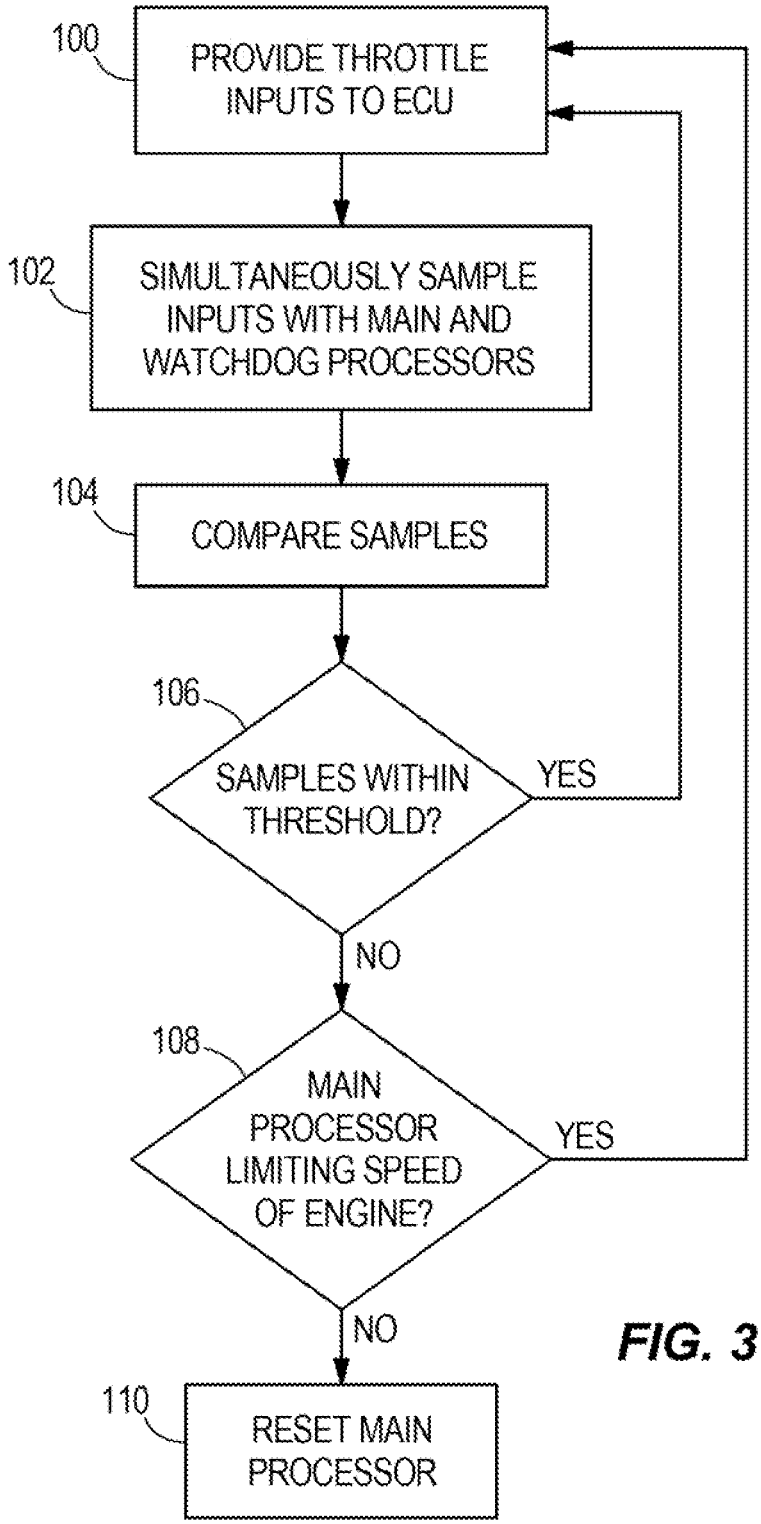
FIG. 3 is a flow chart depicting a method for controlling a marine engine on a marine vessel.

FIG. 3 depicts one example of a method of operating the drive-by-wire control system 12 for the marine engine 16. At step 100, throttle inputs are provided to the ECU 24 via the noted input device 14, cable 28, sensor 30 and links 32*a*, 32*b*. At step 102, the main processor 26 commands the watchdog processor 42 to sample the inputs at the same time as the main processor 26. This is accomplished, in part, via the analog-to-digital converters 34*a* and 34*b* and the sampling link 41. The samples are stored in the memory 17. At step 104, the main processor 26 accesses the memory 17 and compares the samples taken by the main processor 26 and watchdog processor 42. At step 106, the main processor 26 determines whether the respective samples are within a predetermined threshold amount. If yes, the operation of the system 12 continues again at step 100. If no, the main processor 26 is programmed to limit speed of the engine 16 by controlling the throttle 35. At step 108, the watchdog processor 42 via the communication link 43, determines whether the main processor 26 is properly limiting speed of the engine 16 in view of the differential between the respective samples. In another example, the watchdog processor 42 can determine via the engine speed link 44 whether the main processor 26 is properly limiting speed. If yes, the watchdog processor 42 continues its normal operation at step 100. If no, at step 110, the watchdog processor 42 resets the main processor via the reset link 46.

The present disclosure thus provides methods for operating a drive-by-wire control system 12 for a marine engine 16, including the steps of: providing throttle inputs to ECU 24 located with the marine engine 16, sampling the inputs at the same time with a main processor 26 and watchdog processor 42 located in the ECU 24, wherein said sampling is facilitated by a sampling link 41 that is separate and distinct from the communication link 43; controlling with the main processor 26 located in the ECU 24, the speed of the engine 16 based upon the inputs; periodically comparing samples of the inputs that are simultaneously taken by the main processor 26 and watchdog processor 42; decreasing, with the main processor 26, the speed of the engine 24 when the samples differ from each other by more than a predetermined threshold amount; and resetting, with the watchdog processor 42, the main processor 26 when the samples of the inputs are different by a predetermined amount and the main processor 26 does not limit the speed of the engine 16.

The above described systems and methods advantageously allow for the respective processors 26, 42 to sample at substantially the same time (within microseconds of each other), thus allowing the diagnostic threshold for the samples to be significantly smaller, particularly on high rate of change signals such as demand and throttle position. This type of synchronized sampling allows for a simpler communication strategy between the processors 26, 42, no longer having to worry about sampling delays between the processors 26, 42. Further, the use of a single electrical connection or hard wire pin in conjunction with the capabilities of the microprocessors 26, 42 to synchronize sampling provides an elegant, low cost solution to problems associated with delays in the sampling of analog-to-digital values.

What is claimed is:

1. A drive-by-wire control system for a marine engine, the control system comprising:

an input device that is manually positionable to provide operator inputs to an engine control unit (ECU) located with the marine engine, the ECU having a main processor that receives the inputs and controls speed of the marine engine based upon the inputs and a watchdog processor that receives the inputs and monitors operations of the main processor based upon the inputs;

a communication link by which the operations of the main processor and watchdog processor are communicated to each other; and a sampling link that is separate and distinct from the communication link, and via which the main processor commands the watchdog processor to sample the inputs from the input device at the same time as the main processor;

wherein the main processor periodically compares samples of the inputs that are simultaneously taken by the main processor and watchdog processor and limits the speed of the engine when the samples differ from each other by more than a predetermined amount.

2. The control system according to claim 1, wherein the samples are stored in a memory.

3. The control system according to claim 1, wherein the watchdog processor periodically compares the samples.

4. The control system according to claim 3, wherein the input device comprises a throttle lever and further comprising a sensor that outputs analog voltages based upon positions of the throttle lever.

5. The control system according to claim 4, wherein movement of the throttle lever causes movement of a mechanical cable, and wherein the sensor outputs the voltages based upon the movement of the mechanical cable.

6. The control system according to claim 5, wherein the sensor comprises at least one of a linear position sensor and a rotational position sensor.

7. The control system according to claim 5, wherein the main processor comprises a main analog-to-digital converter that converts the voltages to analog-to-digital counts, wherein the watchdog microprocessor comprises a watchdog analog-to-digital converter that converts the voltages to analog-to-digital counts.

8. The control system according to claim 7, wherein the watchdog processor monitors operations of the main analog-to-digital converter by determining whether the main processor decreases speed of the engine when the samples differ from each other by more than the predetermined amount.

9. The control system according to claim 8, wherein the main microprocessor controls position of a throttle to change speed of the engine, and wherein watchdog processor monitors the position of the throttle to determine speed of the engine.

10. The control system according to claim 8, wherein the watchdog processor resets the main processor when the samples differ from each other by more than the predetermined amount and the main processor does not limit the speed of the engine.

11. The control system according to claim 1, wherein the communication link is a serial peripheral interface (SPI) bus.

12. A drive-by-wire control system for a marine engine, the control system comprising:

a throttle lever that is manually positionable to control throttle of the marine engine;

a sensor that outputs analog voltages based upon positions of the throttle lever;

an engine control unit (ECU) that is located with the marine engine, the ECU having a main processor and a watchdog processor, wherein the main processor comprises a main analog-to-digital converter that converts the voltages to analog-to-digital counts, wherein the watchdog processor comprises a watchdog analog-to-digital converter that converts the voltages to analog-to-digital counts;

wherein the main processor controls speed of the marine engine based upon the analog-to-digital counts and wherein the watchdog processor monitors operations of the main processor based upon the analog-to-digital counts;

a serial peripheral interface (SPI) bus by which the operations of the main processor are communicated to the watchdog processor; and a sampling link that is separate and distinct from the SPI bus, and via which the main processor causes the watchdog processor to sample the analog-to-digital counts at the same time as the main processor;

wherein the main processor monitors operations of the main analog-to-digital converter by periodically comparing samples of the analog-to-digital counts that are simultaneously taken by the main and watchdog processors.

13. The control system according to claim 12, wherein the watchdog processor periodically compares the samples of the analog-to-digital counts, wherein the main processor limits speed of the engine when the samples of the inputs are different by a predetermined amount, and comprising a reset link, and wherein the watchdog processor resets the main processor via the reset link when the samples of the inputs are different by a predetermined amount and the main processor does not limit the speed of the engine.

14. A method of operating a drive-by-wire control system for a marine engine, the method comprising:

providing throttle inputs to an engine control unit (ECU) located with the marine engine, wherein the ECU has a main processor that receives the inputs and controls speed of the marine engine based upon the inputs, a watchdog processor that receives the inputs and monitors operations of the main processor based upon the inputs, and a communication link by which the operations of the main processor are communicated to the watchdog processor; sampling the inputs at the same time with the main processor and watchdog processor, wherein said sampling is facilitated by a sampling link that is separate and distinct from the communication link;

controlling with the main processor, the speed of the engine based upon the inputs;

periodically comparing samples of the inputs that are simultaneously taken by the main processor and watchdog processor; and limiting, with the main processor, the speed of the engine when the samples differ from each other by more than a predetermined amount.

15. The method according to claim 14, further comprising storing the samples in a memory associated with the main processor.

16. The method according to claim 14, comprising providing the throttle inputs to the ECU by manually positioning a throttle lever.

17. The method according to claim 16, comprising outputting analog voltages to the ECU based upon positions of the throttle lever.

18. The method according to claim 17, wherein the main processor comprises a main analog-to-digital converter that converts the voltages to analog-to-digital counts, wherein the watchdog microprocessor comprises a watchdog analog-to-digital converter that converts the voltages to analog-to-digital counts and comprising monitoring operations of the watchdog and main analog-to-digital converters by comparing samples of the analog-to-digital counts that are simultaneously taken by the main processor and watchdog processor.

19. The method according to claim 14, comprising controlling, with the main microprocessor, position of a throttle to change speed of the engine, and wherein watchdog processor monitors position of a throttle to determine speed of the engine.

20. The method according to claim 19, comprising resetting, with the watchdog processor, the main processor when the samples of the inputs are different by a predetermined amount and the main processor does not limit the speed of the engine.

* * * * *